United States Patent [19]

McAliley et al.

[11] Patent Number: 4,534,919

[45] Date of Patent: Aug. 13, 1985

[54] PRODUCTION OF A CARBON FIBER MULTIFILAMENTARY TOW WHICH IS PARTICULARLY SUITED FOR RESIN IMPREGNATION

[75] Inventors: J. Eugene McAliley, Rock Hill, S.C.; Gene P. Daumit, Charlotte; Fredrick A. Ethridge, Waxhaw, both of N.C.

[73] Assignee: Celanese Corporation, New York, N.Y.

[21] Appl. No.: 527,728

[22] Filed: Aug. 30, 1983

[51] Int. Cl.[3] ..... D01F 9/12

[52] U.S. Cl. ..... 264/29.2; 264/29.6; 264/29.7; 264/108; 264/136; 423/447.4; 423/447.6; 423/447.8

[58] Field of Search ..... 264/29.2, 29.6, 29.7, 264/108; 423/447.4, 447.6, 447.7, 447.8; 425/71

[56] References Cited

U.S. PATENT DOCUMENTS

| | | | |
|---|---|---|---|
| 2,379,824 | 7/1945 | Mummery | 34/12 |
| 2,783,609 | 3/1957 | Breen | 57/140 |
| 2,799,915 | 7/1957 | Barnett et al. | 423/447.4 |
| 2,985,995 | 5/1961 | Bunting, Jr. et al. | 57/140 |
| 3,017,737 | 1/1962 | Breen | 57/34 |
| 3,226,773 | 1/1966 | Paliyenko | 19/66 |
| 3,237,269 | 3/1966 | Hawkins | 28/1 |
| 3,262,179 | 7/1966 | Sparling | 28/1 |
| 3,279,164 | 10/1966 | Breen et al. | 57/157 |
| 3,376,609 | 4/1968 | Kalwaites | 19/66 |
| 3,508,874 | 4/1970 | Rulson | 423/447.4 |
| 3,539,295 | 11/1970 | Ram | 423/447.6 |
| 3,656,904 | 4/1972 | Ram | 423/447.7 |
| 3,704,485 | 12/1972 | Hall | 19/65 T |
| 3,723,157 | 3/1973 | Orvin | 423/447.8 |
| 3,723,605 | 3/1973 | Ram | 423/447.7 |
| 3,727,274 | 4/1973 | White | 28/1.4 |
| 3,760,458 | 9/1973 | Pitt | 19/66 T |
| 3,769,390 | 10/1973 | Weisbeck et al. | 423/447.4 |
| 3,775,520 | 11/1973 | Ram et al. | 423/477.8 |
| 3,795,944 | 3/1974 | Daniels | 19/65 T |
| 3,798,095 | 3/1974 | Hall | 156/73 |
| 3,844,822 | 10/1974 | Boss et al. | 118/59 |
| 3,873,389 | 3/1975 | Daniels | 156/181 |
| 3,900,556 | 8/1975 | Clarke | 423/447.7 |
| 3,914,393 | 10/1975 | Ram et al. | 423/447.7 |
| 3,925,524 | 12/1975 | Kimmel et al. | 423/447.4 |
| 3,954,947 | 5/1976 | Didclenko et al. | 423/447.4 |
| 3,954,950 | 5/1976 | Ram et al. | 423/447.6 |
| 4,020,273 | 4/1977 | Dix et al. | 373/110 |
| 4,112,059 | 9/1978 | DiEdwardo et al. | 264/29.2 |
| 4,186,179 | 1/1980 | Katsuki et al. | 264/29.2 |
| 4,295,844 | 10/1981 | Warner | 423/447.4 |
| 4,349,279 | 8/1982 | Saji et al. | 264/29.7 |
| 4,370,141 | 1/1983 | Lee et al. | 264/29.2 |
| 4,452,860 | 6/1984 | Obama et al. | 264/29.2 |

FOREIGN PATENT DOCUMENTS

| | | | |
|---|---|---|---|
| 2639409 | 3/1977 | Fed. Rep. of Germany | 264/29.2 |
| 0004825 | 6/1981 | Japan | 264/29.2 |
| 0036216 | 8/1981 | Japan | 264/29.2 |

*Primary Examiner*—Jeffery Thurlow
*Assistant Examiner*—Patrick Dailey
*Attorney, Agent, or Firm*—Burns, Doane, Swecker & Mathis

[57] ABSTRACT

An improved process is provided for the thermal conversion of a multifilamentary tow of an acrylic fibrous material wherein the filaments are disposed in a substantially parallel relationship in a multifilamentary tow of carbonaceous fibrous material which contains at least 70 percent (preferably at least 90 percent) carbon by weight. During at least one stage of the process the multifilamentary tow is subjected to the impingement of at least one stream of a liquid whereby the parallel relationship of the filaments is disrupted in the substantial absence of filament damage with the filaments becoming decolumnized to a degree sufficient to enable the resulting carbonaceous fibrous material to be more readily impregnated by and dispersed within a matrix-forming resin. In a preferred embodiment such impingement is carried out following a thermal stabilization step and prior to a carbonization step while the multifilamentary tow is simultaneously completely submerged within a liquid. The particularly preferred liquid for use in the process is water.

26 Claims, No Drawings

PRODUCTION OF A CARBON FIBER MULTIFILAMENTARY TOW WHICH IS PARTICULARLY SUITED FOR RESIN IMPREGNATION

BACKGROUND OF THE INVENTION

In the search for high performance materials, considerable interest has been focused upon carbon fibers. The terms "carbon" fibers or "carbonaceous" fibers are used herein in the generic sense and include graphite fibers as well as amorphous carbon fibers. Graphite fibers are defined herein as fibers which consist essentially of carbon and have a predominant x-ray diffraction pattern characteristic of graphite. Amorphous carbon fibers, on the other hand are defined as fibers in which the bulk of the fiber weight can be attributed to carbon and which exhibit an essentially amorphous x-ray diffraction pattern. Graphite fibers generally have a higher Young's modulus than do amorphous carbon fibers and in addition are more highly electrically and thermally conductive. It will be understood however, that all carbon fibers including amorphous carbon fibers tend to include at least some crystalline graphite.

Industrial high performance materials of the future are projected to make substantial utilization of fiber reinforced composites, and carbon fibers theoretically have among the best properties of any fiber for use as high strength reinforcement. Among these desirable properties are corrosion and high temperature resistance, low density, high tensile strength and high modulus. During such service, the carbon fibers commonly are positioned within the continuous phase of a resinous matrix (e.g. a solid cured epoxy resin). Uses for carbon fiber reinforced composites include aerospace structural components, rocket motor casings, deep-submergence vessels, ablative materials for heat shields on re-entry vehicles, strong lightweight sports equipment, etc.

As is well known in the art, numerous processes have heretofore been proposed for the thermal conversion of organic polymeric fibrous materials (e.g. an acrylic multifilamentary tow) to a carbonaceous form while retaining the original fibrous configuration substantially intact. See for instance, the following commonly assigned U.S. Pat. Nos. 3,539,295; 3,656,904; 3,723,157; 3,723,605; 3,775,520; 3,818,082; 3,844,822; 3,900,556; 3,914,393; 3,925,524; 3,954,950; and 4,020,273. During commonly practiced carbon fiber formation techniques a multifilamentary tow of substantially parallel or columnized carbon fibers is formed with the individual "rod-like" fibers lying in a closely disposed side-by-side relationship.

In order for the resulting carbon fibers to serve well as fibrous reinforcement within a continuous phase of resinous material it is essential that the individual fibers be well dispersed within the matrix-forming resinous material prior to its solidification. Accordingly, it is essential when forming a composite article of optimum physical properties that the resinous material well impregnate the multifilamentary array of the carbon fibers so that resinous material is present to at least some degree in interstices between the individual fibers. If this does not occur resin rich areas will tend to be present in the resulting composite article. See, for instance, the disclosures of U.S. Pat. Nos. 3,704,485; 3,795,944; 3,798,095; and 3,873,389 where the pneumatic spreading of such carbon fibers was proposed prior to their resin impregnation. It has been found, however, that the pneumatic treatment of the fibers to accomplish decolumnization without spreading has tended to damage and to weaken to an excessive degree the relatively delicate fibers frequently to the extent of fiber breakage thereby creating an additional problem for those who choose to practice this additional process step and/or those carrying out the subsequent processing of the fibrous material.

It is an object of the present invention to provide an improved process for the production of a carbon fiber multifilamentary tow which is particularly suited for resin impregnation beginning with an acrylic fibrous precursor.

It is an object of the present invention to provide an improved process which may be carried out on a reliable and predictable basis for the production of a carbon fiber multifilamentary tow which is particularly suited for resin impregnation.

It is an object of the present invention to provide an improved process for the production of carbon fiber multifilamentary tow wherein the substantially parallel relationship of the individual filaments is disrupted in the substantial absence of filament breakage with the filaments becoming at least partially decolumnized.

It is an object of the present invention to provide an improved process for the production of carbon fibers which may be incorporated in a resin matrix to form a quality substantially void-free composite article which performs well in core crush and compression beam testing.

It is an object of the present invention to provide a multifilamentary tow and carbonaceous fibrous material containing at least 70 percent carbon by weight wherein the filaments thereof are substantially decolumnized and are capable of being readily impregnated by and dispersed within a matrix-forming resin.

It is an object of the present invention to provide a multifilamentary tow of carbonaceous fibrous material containing at least 70 percent carbon by weight wherein the filaments present therein are substantially decolumnized, which handles well, may be readily woven, and which is substantially free of deleterious surface fuzz.

It is a further object of the present invention to provide an improved process for forming an at least partially decolumnized carbon fiber multifilamentary tow which does not require the need for pneumatic filament spreading and the expense associated with the compression and supply of the required compressed air.

These and other objects, as well as the scope, nature, and utilization of the claimed process will be apparent to those skilled in the art from the following detailed description and appended claims.

SUMMARY OF THE INVENTION

It has been found that in a process for the simultaneous conversion of a plurality of acrylic filaments capable of undergoing conversion to a carbonaceous fibrous material selected from the group consisting essentially of an acrylonitrile homopolymer and an acrylonitrile copolymer containing at least about 85 mole percent of acrylonitrile units and up to about 15 mole percent of one or more monovinyl units copolymerized therewith, while in the form of a multifilamentary tow wherein the filaments therein are disposed in a substantially parallel relationship wherein the multifilamentary tow is passed in the direction of its length through a plurality of heating zones while substantially suspended therein to form a multifilamentary fibrous product which contains at least 70 percent (preferably at least 90 percent) carbon by weight; that improved results are achieved by subjecting the multifilamentary tow during at least one stage in its processing to the impingement of at least one stream of a liquid whereby the parallel relationship of the filaments is disrupted in the substantial absence of filament damage with the filaments becoming decolumnized to a degree sufficient to enable the resulting carbonaceous fibrous material to be more readily impregnated by and dispersed within a matrix-forming resin.

In a preferred embodiment it has been found that an improved process for forming a carbonaceous fibrous material which is particularly suited for use as fibrous reinforcement in a resinous matrix material beginning with a multifilamentary tow of substantially parallel acrylic filaments selected from the group consisting essentially of an acrylonitrile homopolymer and an acrylonitrile copolymer containing at least about 85 mole percent of acrylonitrile units and up to about 15 mole percent of one or more monovinyl units copolymerized therewith comprises:

(a) continuously passing in the direction of its length the multifilamentary tow of substantially parallel acrylic filaments through a stabilization zone provided with a heated oxygen-containing atmosphere wherein the acrylic filaments are rendered black in appearance, non-burning when subjected to an ordinary match flame, and capable of undergoing carbonization, (b) continuously passing in the direction of its length the resulting thermally stabilized multifilamentary tow of acrylic filaments through a zone wherein the filaments are subjected to the impingement of at least one stream of a liquid while simultaneously being completely submerged within a liquid whereby the substantially parallel relationship of the filaments is disrupted with the filaments becoming at least partially decolumnized in the substantial absence of filament damage, (c) drying the resulting thermally stabilized multifilamentary tow of at least partially decolumnized filaments, and (d) continuously passing in the direction of its length the resulting thermally stabilized multifilamentary tow of at least partially decolumnized acrylic filaments through a carbonization zone provided with a non-oxidizing atmosphere at a temperature of at least 1000° C. to form a multifilamentary tow of carbonaceous fibrous material which contains at least 90 percent carbon by weight wherein the decolumnization imparted in step (b) is substantially retained and the product is capable of readily being impregnated by and dispersed within a matrix-forming resin.

DESCRIPTION OF PREFERRED EMBODIMENTS

The Starting Material

A multifilamentary tow of acrylic filaments is selected for use in the process of the present invention. Such acrylic tow may be formed by conventional solution spinning techniques (i.e. dry spinning or wet spinning) and the filaments are drawn to increase their orientation. As is known in the art, dry spinning is commonly conducted by dissolving the polymer in an appropriate solvent, such as N,N-dimethylformamide or N,N-dimethylacetamide, and passing the solution through an opening of predetermined shape into an evaporative atmosphere (e.g. nitrogen) in which much of the solvent is evaporated. Wet spinning is commonly conducted by passing a solution of the polymer through an opening of predetermined shape into an aqueous coagulation bath.

The acrylic polymer selected may be either an acrylonitrile homopolymer or an acrylonitrile copolymer containing at least about 85 mole percent of acrylonitrile units and up to about 15 mole percent of one or more monovinyl units. In a preferred embodiment the acrylic polymer is either an acrylonitrile homopolymer or an acrylonitrile copolymer containing at least about 95 mole percent of acrylonitrile units and up to about 5 mole percent of one or more monovinyl units. Such monovinyl units may be derived from a monovinyl compound which is copolymerizable with acrylonitrile units such as styrene, methyl acrylate, methyl methacrylate, vinyl acetate, vinyl chloride, vinylidene chloride, vinyl pyridine, and the like.

The multifilamentary tow is composed of a plurality of substantially parallel and substantially untwisted filaments. Such individual filaments commonly possess a denier per filament of approximately 0.5 to 2.0, and most preferably approximately 0.9. The multifilamentary tow commonly is composed of approximately 1,000 to 50,000 substantially aligned continuous filaments (e.g. approximately 3,000, 6,000, 9,000 or 12,000 continuous filaments).

Various catalytic agents which serve to expedite or to otherwise advantageously influence the thermal stabilization reaction may be incorporated within the filaments of the multifilamentary tow.

The Formation of Carbon Fibers

The multifilamentary tow of acrylic fibers is passed through a plurality of heating zones provided with appropriate gaseous atmospheres while substantially suspended therein to form a multifilamentary fibrous product which contains at least 70 percent (preferably at least 90 percent) carbon by weight.

The multifilamentary tow of acrylic fibers is initially passed through a stabilization zone which is provided with a heated oxygen-containing atmosphere wherein the filaments are rendered black in appearance, non-burning when subjected to an ordinary match flame, and capable of undergoing carbonization. The preferred oxygen-containing atmosphere is air. A temperature gradient may be provided in the thermal stabilization zone, or the multifilamentary tow optionally may be passed through a plurality of discrete zones which are provided at successively elevated temperatures. Alternatively, a single stabilization zone may be provided which is maintained at a substantially constant temperature. The stabilization reaction of the acrylic fibrous material commonly involves (1) an oxidative cross-linking reaction of adjoining molecules as well as (2) a cyclization reaction of pendant nitrile groups to a condensed dihydropyridine structure. The thermal stabilization reaction commonly is carried out at a temperature in the range of approximately 220° C. to 320° C. over a period of several hours. Various known techniques for expediting the thermal stabilization reaction optionally may be employed. Representative thermal stabilization techniques which may be selected are disclosed in commonly assigned U.S. Pat. Nos. 3,539,295; 3,592,595; 3,650,668; 3,656,882; 3,656,883; 3,708,326; 3,729,549; 3,813,219; 3,820,951; 3,826,611; 3,850,876; 3,923,950; 3,961,888; 4,002,426; 4,004,053; and 4,374,114; and British Pat. No. 1,278,676 which are herein incorporated by reference.

The multifilamentary tow of thermally stabilized acrylic filaments is passed in the direction of its length through a carbonization zone provided with a non-oxidizing atmosphere which is maintained at a temperature of at least 700° C. (e.g. 1000° to 2000° C., or more). Suitable non-oxidizing atmospheres include nitrogen, argon, and helium. The carbonization zone optionally may be provided with a temperature gradient which progressively increases, or the multifilamentary tow optionally may be passed through a plurality of discrete zones provided at successively elevated temperatures. Alternatively, a single carbonization zone may be provided which is maintained at a substantially constant temperature (e.g. in the range of 1200 to 1600° C.). The multifilamentary tow of thermally stabilized acrylic filaments is retained within the carbonization zone for sufficient time to yield a carbonaceous fibrous material which contains at least 70 percent carbon by weight (e.g. at least 90 or at least 95 percent carbon by weight in some embodiments). If the temperature of the carbonization zone rises to 2000° C. (e.g. 2000° to 3000° C.) substantial amounts of graphitic carbon will be present in the product and the product will tend to exhibit higher modulus values. Representative carbonization techniques which may be selected are disclosed in commonly assigned U.S. Pat. Nos. 3,539,295; 3,677,705; 3,775,520; 3,900,556; 3,914,393; 3,954,950; and 4,020,275.

The resulting multifilamentary tow of carbonaceous fibrous material which contains at least 70 percent (preferably at least 90 percent) carbon by weight may next be subjected to a surface treatment whereby its ability to adhere to a resinous matrix material (e.g. an epoxy resin) is enhanced. During such surface treatment the resulting carbonaceous fibrous material may be passed in the direction of its length through an appropriate zone whereby the desired surface treatment is carried out in accordance with known techniques. Representative surface treatment techniques which may be selected are disclosed in commonly assigned U.S. Pat. Nos. 3,723,150; 3,723,607; 3,745,104; 3,754,957; 3,859,187; 3,894,884; and 4,374,114 which are herein incorporated by reference.

The Decolumnization Treatment

In accordance with the concept of the present invention the multifilamentary tow during at least one stage of its processing is subjected to the impingement of at least one stream of a liquid whereby the parallel relationship of the filaments is disrupted in the substantial absence of filament damage with the filaments becoming decolumnized to a degree sufficient to enable the resulting carbonaceous fibrous material to be more readily impregnated by and disposed within a matrix-forming resin. Such treatment may be carried out at various times throughout the processing of the multifilamentary tow. In the event the decolumnization is accomplished at an early point in time, the desired decolumnization is substantially retained during subsequent processing. Representative times when decolumnization in accordance with the concept of the present invention can be carried out include (1) treatment of the multifilamentary acrylic precursor prior to thermal stabilization, (2) treatment of the thermally stabilized multifilamentary tow prior to carbonization, and (3) treatment of the resulting multifilamentary carbonaceous fibrous material containing at least 70 percent carbon by weight following its formation and before or after its surface treatment (if any). In a preferred embodiment the decolumnization in accordance with the concept of the present invention is carried out subsequent to passage through the thermal stabilization zone and prior to passage through a carbonization zone. Such filaments additionally are dried prior to the carbonization step of the process if they are impinged by a liquid at this stage in the process.

In a preferred embodiment the multifilamentary tow is completely submerged within a liquid when being impinged by the at least one stream of liquid to accomplish the desired decolumnization. The liquid in which the multifilamentary tow is submerged is preferably the same liquid which forms the at least one stream which contacts the multifilamentary tow. Alternatively, the multifilamentary tow may be simply suspended at ambient conditions when impinged by the liquid. The particularly preferred liquid for use in the process is water. Other liquids may be selected which are capable of being readily removed from the multifilamentary material prior to subsequent processing. Representative, other liquids include ketones such as acetone; alcohols such as methyl alcohol, ethyl alcohol, and ethylene glycol; aldehydes; chlorinated hydrocarbons; glyme, etc. Alternatively, the liquid may be a conventional size composition (e.g. an aqueous epoxy size emulsion) which would commonly be applied to a carbon fiber product subsequent to its complete formation. In this instance the epoxy portion of the size would be permanently retained upon the surfaces of the filaments and the water portion of the size removed in a conventional drying step.

In a preferred embodiment a plurality of streams of liquid are caused to strike the multifilamentary fibrous material while it continuously passes adjacent liquid spray jets situated along the pathway of the fibrous material. The number of streams may be varied widely with such streams preferably being directed at least partially to different surfaces (i.e. sides) of the multifilamentary fibrous bundle which is being at least partially decolumnized. For instance, 2, 3, 4, 5, 6, 7, etc. streams may be employed. In a particularly preferred embodiment the multifilamentary fibrous material is passed in the direction of its length through a laterally enclosed zone while being subjected to the impact of the at least one stream of liquid. For instance, the multifilamentary fibrous material may be passed through and axially suspended within a duct while being impinged with one or more liquid streams which emerge from ports in the walls of the duct and which are directed inwardly to strike the multifilamentary fibrous material. In such embodiment the multifilamentary fibrous material does not detrimentally contact the walls of the duct.

The angle at which the streams strike the multifilamentary fibrous material may be varied widely. For instance, the streams may strike the multifilamentary fibrous material at an angle of 90 degrees with respect to the axis of the multifilamentary bundle. Alternatively, the stream angle may be directed greater than or less than 90 degrees with the respect to the approaching multifilamentary fibrous material. For instance, the at least one stream may strike the multifilamentary fibrous material at an angle of approximately 135° C. with respect to the approaching multifilamentary fibrous material and serve to generally oppose the foward movement of the multifilamentary tow. Such angle will tend to accomplish maximum decolumnization for a given flow rate and is particularly useful when decolumnization is accomplished prior to the carbonization step.

Alternatively, the at least one stream may strike the multifilamentary tow at an on angle of approximately 45 degrees with respect to the approaching multifilamentary fibrous material and serve to generally aid the forward movement of the multifilamentary tow. Such angle can be used to particular advantage subsequent to the carbonization step. Such 45 degree impingement will require a stream velocity approximately $1\frac{1}{2}$ times that required with a 90 degree impingement to accomplish the same approximate level of decolumnization.

A preferred apparatus arrangement for accomplishing the decolumnization in the process of the present invention is as described in U.S. Pat. No. 3,727,274 which is herein incorporated by reference. For instance, the multifilamentary fibrous material may be passed through a duct which optionally is of a cylindrical configuration and while present therein be struck by streams which emerge from three fluid outlets located in the wall of the duct. For instance, on one side of the cylinder two substantially parallel streams may emerge which are substantially tangential to the bore of the cylinder, and on the opposite side one stream may emerge which is positioned radial to the cylinder with all of the outlets being in a common plane and substantially perpendicular to the path of the multifilamentary fibrous material and to the cylinder. The entry and exit portions at the cylinder through which the multifilamentary fibrous material passes may be flared. Suitable diameters for the cylinder commonly range in size from slightly larger than the outer dimensions (i.e. diameter) of the multifilamentary fibrous material up to approximately 0.5 inch. It should be understood however, that in all instances the configuration of the cylinder is selected so as to well accomodate the multifilamentary fibrous material undergoing treatment.

While the multifilamentary tow is subjected to the impingement of the at least one stream of liquid, the longitudinal tension thereon is adjusted so that at least some lateral displacement of the individual filaments present therein is possible in the substantial absence of filament damage. For instance, a longitudinal tension of approximately 0.003 to 1.0 grams per denier, and most preferably approximately 0.03 to 0.06 grams per denier, conveniently may be employed. Additionally, in preferred embodiments the liquid streams are provided at a pressure of approximately 5 to 200 or more psig, and most preferably at a pressure of approximately 50 to 100 psig when conducted prior to carbonization, and most preferably at a pressure of approximately 10 to 30 psig when conducted after carbonization. The velocity of the liquid streams commonly is approximately 5 to 100 feet per second, and most preferably approximately 45 to 75 feet per second when conducted prior to carbonization, and most preferably approximately 20 to 40 feet per second when conducted after carbonization.

The liquid impingement employed in the carbon fiber production process of the present invention surprisingly has been found capable of accomplishing the desired decolumnization in the substantial absence of filament damage. Accordingly, the present process overcomes the filament damage problems found to be associated heretofore with the pneumatic decolumnization of carbon fibers. The substantial absence of filament damage associated with the process of the present invention may be evidenced by a retention of at least 90 percent (preferably at least 95 percent) of the tensile strength of the carbonaceous fibrous material when compared to a similarly prepared fully columnized carbonaceous fibrous which was not subjected to the liquid impingement.

The multifilamentary tow when subjected to the at least one stream of liquid in the process of the present invention substantially loses the relatively uniform side-by-side columnization of its filaments. More specifically, the individual filaments tend to be displaced from adjoining filaments in a more or less random fashion and removed from precisely parallel axes. The filaments tend to become mildly bulked, entangled and comingled, with numerous cross-over points which did not previously exist. The fibrous structure accordingly becomes more open between adjoining filaments thereby creating a multitude of interstices between filaments which are well adapted to receive a matrix-forming resin in a subsequent processing step.

The degree to which the multifilamentary fibrous material is decolumnized may be determined by the use of a needle pull test. When carrying out such needle pull test the multifilamentary carbonaceous fibrous material is initially sized with an epoxy emulsion size and is then tested in an Instron machine wherein one end of the multifilamentary tow is attached to a fixed load cell, a needle is inserted into the middle of the tow, and the needle is cause to move along an 8 inch section of the multifilamentary tow at a rate of 10 inches per minute. The area under the resulting curve of the load vs. distance is determined and is expressed in gram-inches. A 3,000 filament carbonaceous fibrous material in fully columnized form will commonly exhibit values of approximately 20 to 50 gram-inches when subjected to such test. The product of the present invention when consisting of 3,000 filaments will commonly exhibit values of approximately 100 to 250 gram-inches when subjected to such test. Higher filament count products will tend to exhibit proportionately higher test results. For instance, a 12,000 filament carbonaceous fibrous material in fully columnized form will typically exhibit values of approximately 100 to 200 gram-inches when subjected to the test. The product of the present invention when consisting of 12,000 filaments will commonly exhibit values of 300 to 1,000 gram-inches or higher when subjected to the test.

Accordingly, increased filament cross-over points lead to a more open structure within the carbonaceous fibrous product of the present invention which enables it to be more readily impregnated by and dispersed within a matrix-forming resin (e.g. an epoxy resin). Such more open structure is well retained during subsequent processing of the multifilamentary material. The multifilamentary material handles well and may readily be woven, is substantially free of deleterious surface fuzz, and may be processed efficiently as a prepreg material. Composite articles which incorporate the same can be formed which are substantially free of voids and resin-rich areas. A composite article which incorporates the same will exhibit superior properties when subjected to core crush and compression beam testing.

The following example is presented as a specific illustration of the process of the present invention. It should be understood, however, that the invention is not limited to the specific details set forth in the example.

EXAMPLE

An acrylonitrile copolymer multifilamentary tow consisting of approximately 12,000 substantially parallel continuous filaments consisting of approximately 98 mole percent of acrylonitrile units and approximately 2 mole percent of methylacrylate units is selected as the starting material. The multifilamentary tow following spinning is drawn to increase its orientation and possesses a total denier of approximately 10,800 and a denier per filament of approximately 0.9.

The multifilamentary tow of acrylonitrile copolymer is thermally stabilized by passing in the direction of its length through heated circulating air ovens. The multifilamentary tow is substantially suspended in the circulating air ovens when undergoing thermal stabilization and is directed along its course by a plurality of rollers. While present in such circulating air ovens the multifilamentary tow is heated in the range of 220° to 290° C. for approximately one hour. The resulting thermally stabilized acrylonitrile copolymer tow when it emerges from the circulating air ovens is totally black in appearance, and is nonburning when subjected to an ordinary match flame. It now possesses a total denier of approximately 14,400 and a denier per filament of approximately 1.2. It is observed that the individual filaments of thermally stabilized multifilamentary tow are well aligned and columnized in a substantially uniform manner.

The thermally stabilized acrylonitrile copolymer tow next is passed in the direction of its length through the horizontal cylindrical bore of a device which is directly analogous to that illustrated in FIG. 1 of U.S. Pat. No. 3,727,274 wherein three streams of water strike the multifilamentary tow and the substantially parallel relationship of the filaments is disrupted in the substantial absence of filament damage. The cylindrical bore of the device through which the tow passes possesses a length of 0.5 inch and a diameter of 0.157 inch. On one side of the cylinder two substantially parallel streams emerge having a diameter of 0.052 inch which are substantially tangential to the bore of the cylinder, and on the opposite side one stream emerges having a diameter of 0.052 inch which is positioned radial to the bore of the cylinder and with all of the outlets being in a common plane and substantially perpendicular (i.e. at 90 degrees) to the multifilamentary fibrous material and to the cylinder. The device is completely submerged in water. Water is supplied to each of the three jets at a pressure of approximately 80 psig and at a velocity of approximately 60 feet per second. The thermally stabilized acrylonitrile copolymer is passed through pairs of nip rolls before and after it passes through the device wherein the parallel relationship of the filaments is disrupted and the tow is provided therein while under a longitudinal tension of 400 grams (i.e. while under a longitudinal tension of 0.03 gram per denier).

The resulting thermally stabilized multifilamentary tow of decolumnized acrylic filaments is next dried by passing in the direction of its length through a circulating air oven.

This dried multifilamentary tow is next carbonized by passage in the direction of its length through a furnace provided at a temperature greater than 1200° C. containing a circulating nitrogen atmosphere. The resulting carbonaceous fibrous material contains approximately 95 percent carbon by weight and substantially retains the decolumnization previously imparted. This product may be subjected to an oxidative surface treatment to improve its adhesion to a matrix resin, coated with a conventional sizing composition, and is capable of being readily impregnated by and dispersed within a matrix-forming resin to form a quality composite article.

When the process is repeated in the absence of the decolumnization step, and the tensile strength of the carbonaceous fibrous material is compared to that achieved above, it is found that the tensile strength in each instance is substantially the same thereby indicating that no substantial filament damage occurred while carrying out the decolumnization step of the process of the present invention.

Although the invention has been described with a preferred embodiment, it is to be understood that variations and modifications may be resorted to as will be apparent to those skilled in the art. Such variations and modifications are to be considered within the purview and scope of the claims appended hereto.

We claim:

1. In a process for the simultaneous conversion of a plurality of acrylic filaments capable of undergoing conversion to a carbonaceous fibrous material selected from the group consisting essentially of an acrylonitrile homopolymer and an acrylonitrile copolymer containing at least about 85 mole percent of acrylonitrile units and up to about 15 mole percent of one or more monovinyl units copolymerized therewith, while in the form of a multifilamentary tow wherein the filaments therein are disposed in a substantially parallel relationship wherein said multifilamentary tow is passed in the direction of its length through a plurality of heating zones each containing a heated gaseous atmosphere while substantially suspended therein to form a multifilamentary fibrous product which contains at least 70 percent carbon by weight; the improvement of subjecting said multifilamentary tow during at least one stage in its processing to the impingement of at least one stream of a liquid whereby the parallel relationship of said filaments is disrupted in the substantial absence of filament damage with the filaments becoming decolumnized to a degree sufficient to enable said resulting carbonaceous fibrous material to be more readily impregnated by and dispersed within a matrix-forming resin.

2. An improved process according to claim 1 wherein said acrylic filaments are an acrylonitrile homopolymer.

3. An improved process according to claim 1 wherein said acrylic filaments are an acrylonitrile copolymer which contains at least 95 mole percent of acrylonitrile units and up to about 5 mole percent of one or more monovinyl units copolymerized therewith.

4. An improved process according to claim 1 wherein said multifilamentary tow is composed of approximately 1,000 to 50,000 continuous filaments.

5. An improved process according to claim 1 wherein said multifilamentary tow is initially passed through a stabilization zone and subsequently through a carbonization zone.

6. An improved process according to claim 5 wherein said resulting carbonaceous fibrous material contains at least 90 percent carbon by weight.

7. An improved process according to claim 6 wherein said resulting carbonaceous fibrous material which contains at least 90 percent carbon by weight additionally is passed through a surface treatment zone.

8. An improved process according to claim 1 wherein said multifilamentary tow is submerged in a liquid when being impinged with said at least one stream of a liquid whereby the parallel relationship of said filaments is disrupted.

9. An improved process according to claim 1 wherein said multifilamentary tow is suspended within and continuously passed through a laterally enclosed zone when being impinged with said at least one stream of a liquid whereby the parallel relationship of said filaments is disrupted.

10. An improved process according to claim 1 wherein said stream of liquid is water.

11. An improved process according to claim 1 wherein said substantial absence of filament damage following said impingement is evidenced by the retention of at least 90 percent of the tensile strength of said carbonaceous fibrous material when compared to a similarly prepared carbonaceous fibrous material which was not subjected to said impingement.

12. An improved process according to claim 5 wherein said multifilamentary tow is subjected to the impingement of said at least one stream of liquid prior to passing through said stabilization zone.

13. An improved process according to claim 5 wherein said multifilamentary tow is subjected to the impingement of said at least one stream of liquid subsequent to passing through said stabilization zone and prior to passing through said carbonization zone.

14. An improved process according to claim 5 wherein said carbonaceous fibrous material is subjected to the impingement of said at least one stream of liquid subsequent to passage through said carbonization zone.

15. An improved process for forming a carbonaceous fibrous material which is particularly suited for use as fibrous reinforcement in a resinous matrix material beginning with a multifilamentary tow of substantially parallel acrylic filaments selected from the group consisting essentially of an acrylonitrile homopolymer and an acrylonitrile copolymer containing at least about 85 mole percent of acrylonitrile units and up to about 15 mole percent of one or more monovinyl units copolymerized therewith comprising:

(a) continuously passing in the direction of its length said multifilamentary tow of substantially parallel acrylic filaments through a stabilization zone provided with a heated oxygen-containing atmosphere wherein said acrylic filaments are rendered black in appearance, non-burning when subjected to an ordinary match flame, and capable of undergoing carbonization, (b) continuously passing in the direction of its length said resulting thermally stabilized multifilamentary tow of acrylic filaments through a zone wherein said filaments are subjected to the impingement of at least one stream of a liquid while simultaneously being completely submerged within a liquid whereby the substantially parallel relationship of said filaments is disrupted with the filaments becoming at least partially decolumnized in the substantial absence of filament damage, (c) drying said resulting thermally stabilized multifilamentary tow of at least partially decolumnized filaments, and (d) continuously passing in the direction of its length said resulting thermally stabilized multifilamentary tow of at least partially decolumnized acrylic filaments through a carbonization zone provided with a non-oxidizing atmosphere at a temperature of at least 1000° C. to form a multifilamentary tow of carbonaceous fibrous material which contains at least 90 percent carbon by weight wherein said decolumnization imparted in step (b) is substantially retained and said product is capable of readily being impregnated by and dispersed within a matrix-forming resin.

16. An improved process according to claim 15 wherein said acrylic filaments are an acrylonitrile homopolymer.

17. An improved process according to claim 15 wherein said acrylic filaments are an acrylonitrile copolymer which contains at least 95 mole percent of acrylonitrile units and up to about 5 mole percent of one or more monovinyl units copolymerized therewith.

18. An improved process according to claim 15 wherein said multifilamentary tow is composed of approximately 1,000 to 50,000 continuous filaments.

19. An improved process according to claim 15 wherein said stabilization zone of step (a) is provided with air.

20. An improved process according to claim 15 wherein liquid employed in step (b) is water.

21. An improved process according to claim 15 wherein in step (b) said multifilamentary tow is continuously passed through a laterally enclosed zone when being impinged with said at least one stream of liquid whereby the substantially parallel relationship of the filaments is disrupted in the substantial absence of filament breakage.

22. An improved process according to claim 21 wherein said substantial absence of filament damage following said impingement of step (b) is evidenced by the retention of at least 90 percent of the tensile strength of said carbonaceous fibrous material when compared to a similarly prepared carbonaceous fibrous material which was not subjected to said impingement.

23. An improved process according to claim 21 wherein said resulting thermally stabilized multifilamentary tow in step (b) while under a longitudinal tension of approximately 0.003 to 1.0 grams per denier is simultaneously impinged by a plurality of streams of water while being submerged in water with each stream being provided at a pressure of approximately 5 to 200 psig, and a velocity of approximately 5 to 100 feet per second.

24. An improved process according to claim 23 wherein said streams are directed at angles of approximately 90 degrees with respect to the approaching thermally stabilized multifilamentary tow.

25. An improved process according to claim 23 wherein said streams are directed at angles greater than 90 degrees with respect to the approaching thermally stabilized multifilamentary tow with said streams being directed so as to generally oppose the forward movement of said multifiliamentary tow.

26. An improved process according to claim 23 wherein said streams are directed at angles less than 90 degrees with respect to the approaching thermally stabilized multifilamentary tow with said streams being directed so as to generally aid the forward movement of said multifilamentary tow.

* * * * *